United States Patent [19]

Hansen, Jr.

[11] 4,056,463

[45] Nov. 1, 1977

[54] TOBACCO/PAPER SORTER METHOD AND APPARATUS

[75] Inventor: Charles D. Hansen, Jr., Richmond, Va.

[73] Assignee: AMF Incorporated, White Plains, N.Y.

[21] Appl. No.: 715,779

[22] Filed: Aug. 19, 1976

[51] Int. Cl.[2] ..... B07C 5/344

[52] U.S. Cl. ..... 209/111.7 R

[58] Field of Search ..... 209/73, 74, 75, 111.7, 209/111.6, 111.5, 115

[56] References Cited

U.S. PATENT DOCUMENTS

| | | | |
|---|---|---|---|
| 3,685,650 | 8/1972 | Walther et al. | 209/74 R |
| 3,750,882 | 8/1972 | Hays | 209/111.6 |
| 3,893,563 | 7/1975 | Hansen | 222/227 |

*Primary Examiner*—Allen N. Knowles

*Attorney, Agent, or Firm*—George W. Price; Charles J. Worth

[57] ABSTRACT

The method and apparatus therefor for separating paper particles from reclaimed shredded tobacco comprising propelling shredded tobacco with paper particles randomly mixed therein into a path of flight above an endless belt coneyor and in the direction of movement of the conveyor so that the shredded tobacco showers down and forms a blanket on the conveyor and the longer flying paper showers down atop the tobacco blanket, the conveyor moving the tobacco past scanning means and propelling the tobacco along a path of flight to receiver means, the scanning means detecting paper particles atop the tobacco, and pneumatic reject means responsive to the scanning means for diverting detected paper particles from the path of flight from the conveyor to a receiver for reject particles.

9 Claims, 2 Drawing Figures

TOBACCO/PAPER SORTER METHOD AND APPARATUS

This invention relates generally to reclamation of tobacco and more particularly to reclaiming shredded tobacco from cigarettes found to be defective.

Defective cigarettes are accumulated and fed to machines, such as shown and described in U.S. Pat. No. 3,665,931, which rip or slit the paper wrappers of rejected cigarettes, with or without filters, and separate the wrappers from the tobacco which is collected from reuse. It has been found that, from the ripping or slitting operation, pieces of paper or paper particles are randomly mixed in the shredded tobacco being reclaimed. Processing the reclaimed tobacco to remove the paper heretofore has been a slow and difficult task which tends to further degrade the shredded tobacco.

Accordingly, an object of the present invention is to automatically process reclaimed shredded tobacco from defective cigarettes to remove paper particles therefrom.

Another object of the present invention is to process reclaimed shredded tobacco from defective cigarettes to rapidly remove paper particles randomly mixed in the shredded tobacco with a minimum amount of degradation of the tobacco shreds.

The foregoing and other objects and advantages will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

Figure 1:
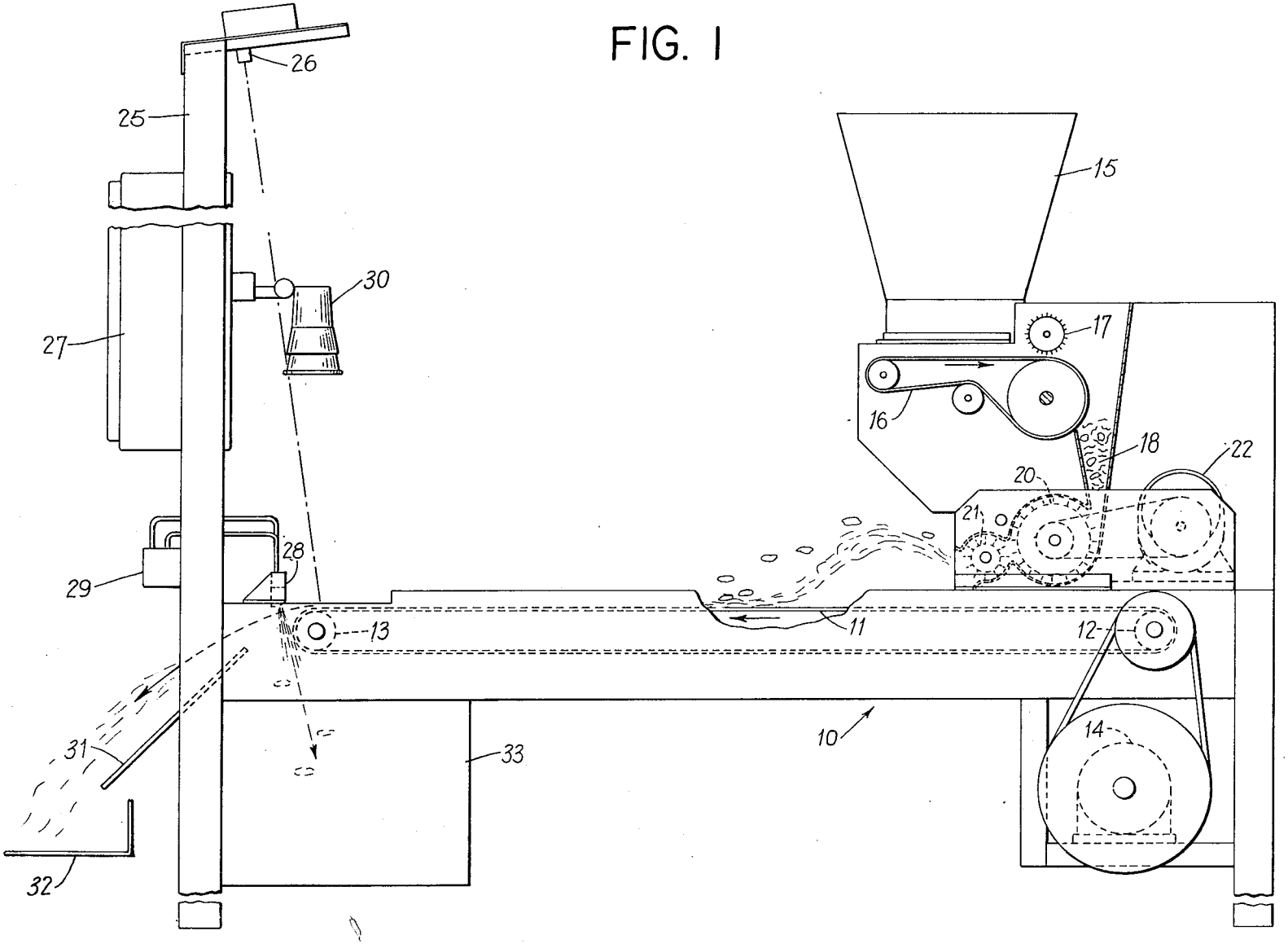
FIG. 1 is an elevational view of a machine for separating paper from shredded tobacco in accordance with the present invention.
Figure 2:
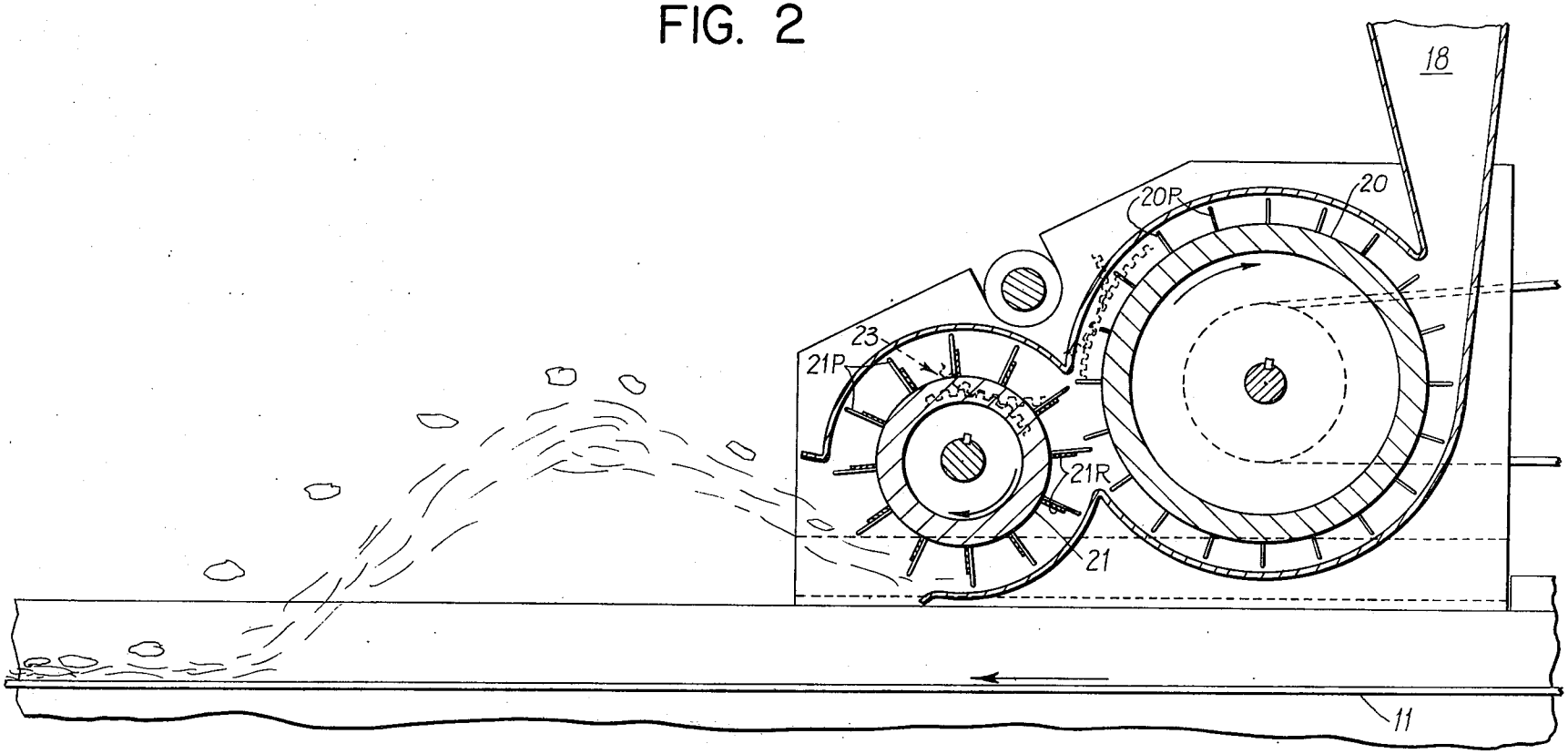
FIG. 2 is an enlarged sectional view of means for separating paper for detection from the shredded tobacco.

The present invention contemplates means generally similar to that in my U.S. Pat. 3,893,563 for detecting and separating paper from the reclaimed shredded tobacco as will be further discussed.

Referring now to the drawings, the machine is provided with a base frame 10 and an elongated horizontally disposed endless belt conveyor 11 mounted on a pair of longitudinally spaced rollers 12 and 13, disposed at opposite ends of the frame 10, and driven at a predetermined speed by a motor 14. A hopper 15 for tobacco to be reclaimed is supported by the frame 10 spaced above the input or rear end of the conveyor 11. Because of the tobacco separating action of a cigarette ripper or slitter, metering means such as a vibrating conveyor or an endless belt conveyor 16 with a picker type roller 17, as shown, is provided to feed tobacco from the hopper 15 at a predetermined rate to a throat or chute 18.

An accumulator roller 20, driven by motor means 22 and drivingly connected by a gear train 23 to an accelerator roller 21, is disposed at the bottom or lower end of the throat or chute 18 and with the accelerator roller 21 is spaced above the infeed or rear end of conveyor 11. Although, as shown, the motor 14 drives the belt conveyor 11, motor 22 drives rollers 20 and 21, and no motor is shown for driving the belt 16 and roller 17, a single prime mover can be used for driving each, all, or any combination of such tobacco moving means within the scope of the present invention.

The accumulator roller 20 is driven at a suitable speed to remove a sufficient amount of tobacco from the chute or throat 18 to fill the accelerator roller 21. The accelerator roller 21, in turn, is driven at a speed suitable for propelling tobacco in a longitudinal flight path above the belt conveyor 11; the flying shredded tobacco and paper particles showering down from the path of flight on to the conveyor 11. It has been found that paper particles resulting from ripping or slitting cigarettes tend to fly or remain air-borne for longer periods of time than the tobacco shreds. Therefore, the flying tobacco will shower down to form a blanket of shredded tobacco on the belt conveyor 11 and the longer flying paper particles will, thereafter, tend to shower down atop the tobacco where they can be readily detected by electro-optical scanning means 26. The belt conveyor 11 is driven at a speed suitable for propelling the shredded tobacco from its delivery end along a path of flight over a baffle plate 31 to receiver means 32, such as a receptacle or a conveyor.

It has been found that appropriate separation for detection of paper particles randomly mixed in shredded tobacco can be accomplished with apparatus, for example, having a 16 inch belt conveyor and rollers with the belt conveyor 11 running at 250 ft./min. the accumulator roller 20 running at 160 RPM and the accelerator roller 21 running at 470 RPM. The accumulator roller 20, with a 4 inch shell diameter is provided with twenty equally spaced rows of radially extending pins 20P. Each of such rows is provided with 67 pins 20P equally spaced along a 15° helix which extends from one end of the roller 20 to the other. The roller 20 when measured from the outer ends of the pins 20P, has effectively a 5½ inch diameter. The accelerator roller 21, with a 2½ inch shell diameter, is provided with twelve equally spaced rows of radially extending pins 21P. Each of such rows is provided with sixty six pins 21P equally spaced along a 15° helix which extends from one end of the roller 21 to the other. The roller 21, when measured from the outer ends of the pins 21P, has effectively a 3¾ inch diameter. To substantially close or reduce the space between adjacent pins 21P, a 5/16 inch blade or rail 21R of sheet material may be connected to each row of pins which extend radially outwardly of the blades or rails and therefore, retain their picker characteristics. The pins 21P pass between the pins 20P and overlap or mesh only to the depth of the blades or rails 21R when such blades or rails are provided.

A vertical end frame 25 is connected to the front end of the base frame 10 immediately forward of the delivery end of the endless belt conveyor 11. The end frame 25 mounts inspection means diagrammatically shown comprising a suitable electro-optical array 26 which scans the flow or blanket of shredded tobacco at the delivery end of the conveyor 11, illuminated by light from a source 30, and provides signals to signal processing means 27 when paper particles are detected on the tobacco being scanned. The signal processing means 27, in response to detect signals from the array or scanning means 26, provides appropriately timed signals to a control value means 29 of a pneumatic reject means having pneumatic jets 28 which divert detected paper particles from the normal flight path, after leaving the conveyor 11, to a reject material receiver 33.

The reject means 28/29 of the present application may be generally similar to the reject means 64 of my U.S. Pat. No. 3,893,563. The detecting means 26/27/30 merely has to differentiate between the white of the paper particles and the dark tobacco and the belt conveyor 11. Thus, the detecting means of the present application can be much less complicated than the detecting means 60 of my U.S. Pat. No. 3,893,563.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. The method of removing paper particles randomly mixed in reclaimed shredded tobacco from defective cigarettes, comprising the steps of creating a shower of the shredded tobacco with paper particles to form a blanket of shredded tobacco with paper particles exposed on top of the formed blanket, electro-optically scanning the blanket of shredded tobacco to detect exposed paper particles;

propelling the scanned blanket of shredded tobacco along a path of flight; and pneumatically diverting detected paper particles from the path of flight.

2. The method in accordance with claim 1, further comprising the steps of providing means at the end of the path of flight for receiving the shredded tobacco; and providing other means for receiving the pneumatically diverted paper particles.

3. The method in accordance with claim 2, further comprising the step of propelling the shredded tobacco with randomly mixed paper particles along another path of flight for creating the shower.

4. The method in accordance with claim 3, further comprising the steps of providing a metered supply of shredded tobacco with randomly mixed paper particles;

providing means for propelling the shredded tobacoo with randomly mixed paper particles along the other path of flight; and providing means for positively feeding tobacco with randomly mixed paper particles from the supply to the propelling means.

5. The method in accordance with claim 4, further comprising the step of providing an endless belt conveyor means receiving the shower forming the blanket thereon, conveying the formed blanket past the scanning means; and propelling the scanned blanket of shredded tobacco along its path of flight.

6. Apparatus for removing paper particles randomly mixed in reclaimed shredded tobacco from defective cigarettes, comprising means for providing a supply of reclaimed shredded tobacco with randomly mixed paper particles;

an endless belt type conveyor;

means for receiving for said supply means and propelling shredded tobacco with paper particles along a path of flight creating a shower of shredded tobacco and separated paper particles;

the shower forming adjacent one end of said conveyor a blanket of shredded tobacco with paper particles exposed on top of the formed blanket;

electro-optical means adjacent the other end of said conveyor for scanning the formed blanket of shredded tobacco and detecting the exposed paper particles;

said conveyor conveying the formed blanket past said electro-optical scanning means and propelling the scanned blanket along another path of flight; and pneumatic reject means diverting detected paper particles from the other path of flight thereby removing the paper particles from the reclaimed shredded tobacco.

7. The apparatus in accordance with claim 6, further comprising means at the end of the other path of flight for receiving reclaimed shredded tobacco, and separate means for receiving diverted paper particles.

8. The apparatus in accordance with claim 7, and said propelling means for the shredded tobacco with paper particles comprising a roller provided with a plurality of rows of radially extending pins;

said rows being equally spaced angularly from one another; and said pins of each of said rows being equally spaced from one end of said roller to the other end thereof.

9. The apparatus in accordance with claim 8, and said supply means comprising a substantially vertically disposed duct and a feed roller;

said duct having an inlet to receive metered shredded tobacco with randomly mixed paper particles and a discharge at its lower end;

said feed roller having a plurality of rows of radially extending pins for removing from the discharge of said duct and feeding the roller of said propelling means shredded tobacco with paper particles;

said rows of pins of said feed roller being equally spaced angularly from one another with the pins of each of such rows being equally spaced from one end of the roller to the other.

* * * * *

UNITED STATES PATENT OFFICE

CERTIFICATE OF CORRECTION

Patent No. 4,056,463 Dated November 1, 1977

Inventor(s) Charles D. Hansen, Jr.

It is certified that error appears in the above-identified patent and that said Letters Patent are hereby corrected as shown below:

Column 4, line 10, "for" second occurrence should read ---from---.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*